US007794339B2

(12) United States Patent
Bailey

(10) Patent No.: US 7,794,339 B2
(45) Date of Patent: Sep. 14, 2010

(54) PULL-THE-TRIGGER HITTER BATTING PRACTICE APPARATUS AND METHOD

(76) Inventor: Clark J. Bailey, 32417 Bear Creek Rd., Grand Rapids, Itasca, MN (US) 55744

( * ) Notice: Subject to any disclaimer, the term of this patent is extended or adjusted under 35 U.S.C. 154(b) by 195 days.

(21) Appl. No.: 12/199,786

(22) Filed: Aug. 27, 2008

(65) Prior Publication Data

US 2009/0062039 A1 Mar. 5, 2009

Related U.S. Application Data

(60) Provisional application No. 60/966,202, filed on Aug. 27, 2007.

(51) Int. Cl.
*A63B 69/00* (2006.01)

(52) U.S. Cl. ..... 473/451; 473/422; 473/427

(58) Field of Classification Search ..... 473/451, 473/422, 417, 423, 426, 427, 429, 431, 453, 473/447, 454–456; 482/87–90, 83; 273/388, 273/390–392, 402, 348, 368, 407
See application file for complete search history.

(56) References Cited

U.S. PATENT DOCUMENTS

| | | | | | |
|---|---|---|---|---|---|
| 157,335 | A | * | 12/1874 | Lyon | 273/390 |
| 518,931 | A | * | 4/1894 | Allen | 273/369 |
| 1,173,456 | A | * | 2/1916 | Neumann | 273/388 |
| 1,212,943 | A | * | 1/1917 | Hart | 273/388 |
| 1,415,823 | A | * | 5/1922 | Fenton | 273/388 |
| 2,890,052 | A | * | 6/1959 | Burrell | 273/375 |
| 2,905,469 | A | * | 9/1959 | Taylor | 273/380 |
| 3,103,362 | A | * | 9/1963 | Elofson | 273/359 |
| 3,118,670 | A | | 1/1964 | Smith | |
| 3,529,823 | A | * | 9/1970 | Garver | 473/418 |
| 3,552,749 | A | * | 1/1971 | Piggotte | 473/448 |
| 3,767,198 | A | | 10/1973 | Boyer | |
| 4,010,950 | A | | 3/1977 | Visockis | |
| 4,050,694 | A | | 9/1977 | Domroski | |
| 4,502,684 | A | | 3/1985 | Rocha | |
| 4,555,110 | A | | 11/1985 | Hai-Ping | |
| 4,664,375 | A | | 5/1987 | Tetreault | |
| 4,708,343 | A | | 11/1987 | D'Ambrosio | |
| 4,964,634 | A | | 10/1990 | Boyer | |
| 5,133,549 | A | | 7/1992 | Vasquez | |
| 5,303,914 | A | | 4/1994 | Cooksey | |
| 5,389,057 | A | * | 2/1995 | Zagata, Jr. | 482/83 |
| 5,467,979 | A | | 11/1995 | Zarate | |
| 5,496,039 | A | * | 3/1996 | Zammuto | 273/404 |
| 5,685,788 | A | | 11/1997 | Shy et al. | |
| D393,029 | S | | 3/1998 | Koo et al. | |

(Continued)

*Primary Examiner*—Mitra Aryanpour
(74) *Attorney, Agent, or Firm*—Albert W. Watkins

(57) ABSTRACT

A baseball hitter batting practice apparatus incorporates an unbalanced and potentially non-planar plurality of targets which are mounted onto a spindle. The spindle rotates about a central generally horizontal axle. The unbalanced targets in one embodiment are spaced at ninety-degree intervals from an adjacent target, thereby causing the spindle to first spin in one direction after a target has been struck, and then to oscillate or rock alternately clockwise and counterclockwise before finally coming to a rest. Striking selected targets in accord with the method of the invention teaches a batter to pull-the-trigger at the appropriate time. A novel support further enhances the utility of the spindle and targets by enabling the spindle to be coupled to many diverse supporting poles and structures.

17 Claims, 5 Drawing Sheets

U.S. PATENT DOCUMENTS 5,788,589 A 8/1998 Koo et al.
5,833,555 A 11/1998 Jer-Min
5,924,930 A * 7/1999 Stewart ..... 473/29
6,478,301 B1 * 11/2002 Witmeyer ..... 273/391
D486,197 S 2/2004 Marshall
7,115,051 B2 10/2006 Hansberry
7,134,977 B2 * 11/2006 Campbell et al. ..... 473/454

* cited by examiner

PULL-THE-TRIGGER HITTER BATTING PRACTICE APPARATUS AND METHOD

CROSS REFERENCE TO RELATED APPLICATIONS

This application claims priority to U.S. provisional patent application Ser. No. 60/966,202 filed Aug. 27, 2007 and having inventor Clark J. Bailey in common, the contents of which are incorporated herein by reference in entirety.

BACKGROUND OF THE INVENTION

1. Field of the Invention

This invention pertains generally to the field of sports training and practice devices for projectile games, and more specifically to a tethered or orbital batting practice device.

2. Description of the Related Art

In baseball or softball, a great deal of skill goes into a batter controlling the ball. Based on the pitch and which bases are loaded, the direction and speed of the hit must vary. In order for a batter to have accurate control of the ball, the batter must have experience with pull and push hitting, and be able to exert control independent of ball location. Participating in the sport undoubtedly increases experience and skill, but in a slow, labor intensive, and uncontrolled way. In other words, there is a significant amount of time required by a pitcher to prepare for and complete a pitch, and then only some of the pitches will be in the batter's strike zone. To most quickly and efficiently gain experience with the different styles of pitches, batters will preferably have repeatable practice, preferably without the delays that arise from a human pitcher.

With this goal in mind, various batting practice machines have been designed. One particularly common type is a batting cage, which is a large, often rectangular, fully fenced area having an automatic pitching machine at one longitudinal end. Distal thereto, a batter stands ready for the pitching machine to fire balls. More elaborate machines are capable of varying the speed and spin of the balls, to more accurately emulate real pitches. As might be appreciated, these types of machines and fencing are quite expensive, and the land space required is relatively large. In addition, these machines may, like a human pitcher, occasionally misfire. While many of these misfires are harmless, in such event a momentary lapse in attention or concentration on the part of the batter can lead to a hazardous impact of the ball against the batter. While such simulations may be relatively realistic, a safe practice apparatus is much preferred for most batting practice.

Batting practice is also commonly obtained using balls supported upon a large tee. This apparatus is relatively safe for an inexperienced batter to use, and has thereby gained much popularity with relatively young baseball players. Over the years this practice aid has evolved, and entire leagues of tee ball have formed. However, as may be appreciated, the ball is entirely static. Consequently, other than learning the most rudimentary of swing fundamentals, a tee is quite limited in developing complete and sound batting techniques. As may be appreciated, depending upon the type of pitch such as a fastball, slider, or curve ball, and also upon the intended direction of the hit, different swings will be required for different pitches in order to gain the best hit. Furthermore, once a ball is hit from the tee, it must be retrieved before it can be struck again. The ball may also still hit objects which are consequently damaged or broken (e.g. windows and cars). So, without a cage or net enclosing the tee, significant time will be lost retrieving balls, and safety of any individuals or objects within the travel distance of the ball may be compromised. To further improve the safety and time associated with a batting tee, whiffle balls are sometimes used that are hollow balls having a plurality of holes passing therethrough. These balls lose velocity extremely rapidly traveling through the air, and generally do not have sufficient mass or hardness to cause any significant harm to surroundings. Unfortunately, between the tee and the whiffle ball, there is little resembling an actual baseball batting session that remains.

Batting practice machines have also been devised that are composed of balls on sticks or strings that pivot or rotate in such a manner which allows them to be hit again, such as those illustrated in prior art patents U.S. Pat. No. 4,555,110 by Hai-Ping, entitled "Ball-hitting training device;" U.S. Pat. No. 5,133,549 by Vasquez, entitled "Ball-hitting practice device;" U.S. Pat. No. 5,303,914 by Cooksey, entitled "Triple-adjustable height batting practice device;" U.S. Pat. No. 5,467,979 by Zarate, entitled "Baseball batting practice device;" U.S. Pat. No. 5,685,788 by Shy et al, entitled "Shock-absorbable ball practice device;" and U.S. Pat. No. 5,788,589 and U.S. Pat. No. Des 393,029 by Koo et al, entitled "Batting practice machine for baseball;" the contents and teachings of each which are incorporated herein by reference. The string mounted balls offer immediate and clear feedback in whether the direction of impact was proper. Unfortunately, these apparatus slow down the practice session, since it may take some time for the ball and string to reset from an errant hit, and they require substantial space from adjacent objects, since there is little other than the length of the string or rope to limit how far from the hitting location the ball may travel. In other words, if the ball is on a three foot string, there should not be anything within three feet in any direction which could be harmed by the ball. One obvious shortcoming is that the batter will typically be within the range of the string, and so an errant hit may not only send the ball on an errant path, but this path could also be dangerous to either the batter or those around him. The prior art also lacks the combination of repeatable variability in the direction of the object to be hit combined and repeatable variability in the style of hits. Two patents, U.S. Pat. No. 5,833,555 by Jer-Min, entitled "Gravitationally restored ball practice device;" and U.S. Pat. No. 3,118,670 by Smith, entitled "Baseball batting practice device;" the contents which are also incorporated herein by reference, illustrate this well. These patents both illustrate horizontal axis rotary batting practice devices. As may be appreciated, these devices provide a ball or ball-like object terminating a relatively rigid rod extending radially from the horizontal axis. This facilitates relatively predictable batting practice for pitches that vary by spin, such as a fastball, curve ball, and slider, but all will remain a consistent and predictable distance from the batter. Furthermore, it is somewhat more difficult than desired to vary the simulation of types of pitches with either of these batting practice apparatus.

Additional documents which illustrate various batting practice aids, the contents of each which are incorporated herein by reference, include: U.S. Pat. No. 3,767,198 by Boyer, entitled "Batting practice device and method;" U.S. Pat. No. 4,964,634 by Boyer, entitled "Tethered ball batting practice device;" U.S. Pat. No. 4,010,950 by Visockis, entitled "Baseball batting practice apparatus;" U.S. Pat. No. 4,050,694 by Domroski, entitled "Batting practice kit;" U.S. Pat. No. 4,502,684 by Rocha, entitled "Batting practice device for baseball;" U.S. Pat. No. 4,664,375 by Tetreault, entitled "Baseball batting practice device;" U.S. Pat. No. 4,708,343 by D'Ambrosio, entitled "Apparatus for baseball batting practice;" U.S. Pat. No. 7,115,051 by Hansberry, entitled "Practice equipment;" and U.S. Pat. No. Des 486,197 by Marshall, entitled "Batting aid." In addition, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a batting practice apparatus. The apparatus has a spindle having a central hole, a hub immediately adjacent the central hole, and three target supporting rings. An axle passes through the spindle central hole. Each of three batting targets are coupled with a respective one of the three target support rings, the axle passing through at least one of the three targets.

In a second manifestation, the invention is a readily adaptable batting practice support. The batting practice support has a spindle, an axle, and three targets mounted upon the axle. A bracket is coupled to the spindle, and has a pivot therein. A shaft is pivotal about the bracket pivot, and a riser has a runner and terminating clamps. The bracket is adjustably coupled to the riser and repositionable relative to the runner to permit a person to adjust a height of the spindle.

In a third manifestation, the invention is a multi-variable batting practice spindle. A spindle has a hole, a hub immediately adjacent the hole, and a plurality of target supports. An axle passes through the spindle hole. A plurality of targets are coupled with a respective one of the plurality of target supports and each one of the targets defines a longitudinal axis. A longitudinal axis of a first one of the plurality of targets forms an acute angle with the axle. A longitudinal axis of a second one of the plurality of targets forms an obtuse angle with the axle, wherein the target longitudinal axes are not co-planar.

OBJECTS OF THE INVENTION

Exemplary embodiments of the present invention solve inadequacies of the prior art by providing an unbalanced and potentially non-planar plurality of targets which are mounted onto a spindle. The spindle rotates about a central generally horizontal axle. A novel support further enhances the utility of the spindle and targets.

A first object of the invention is to facilitate batting practice with a minimum of space and expense required. A second object of the invention is to limit human intervention other than the batter practicing the swings, including reduced set-up time, ease of transport and ease of storage. Another object of the present invention is to provide realistic practice that includes variability of spin, speed, angle of impact, and distance from the batter. A further object of the invention is to provide a durable apparatus which can withstand repeated impacts, whether these impacts are on target or not. Yet another object of the present invention is to ensure safe practice which does not endanger either the batter or others who may be nearby.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides an unbalanced and potentially non-planar rotary batting practice apparatus which has a plurality of batting targets which emulate different pitches and preferred hits for random but rapid, safe and relatively repeatable pitch emulation.

Figure 1:
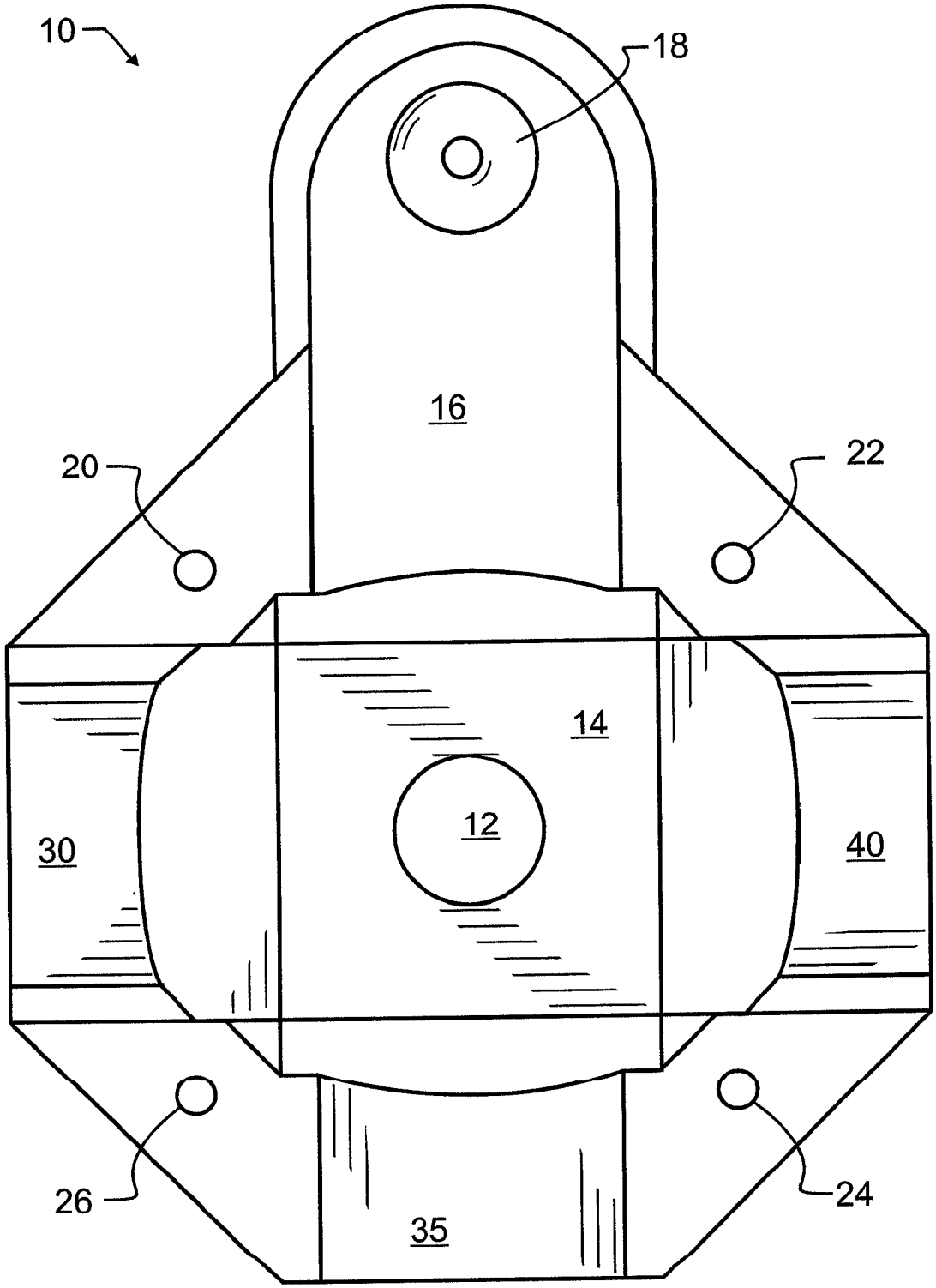
FIG. 1 illustrates a preferred embodiment spindle designed in accord with the teachings of the present invention from front plan view.
Figure 2:
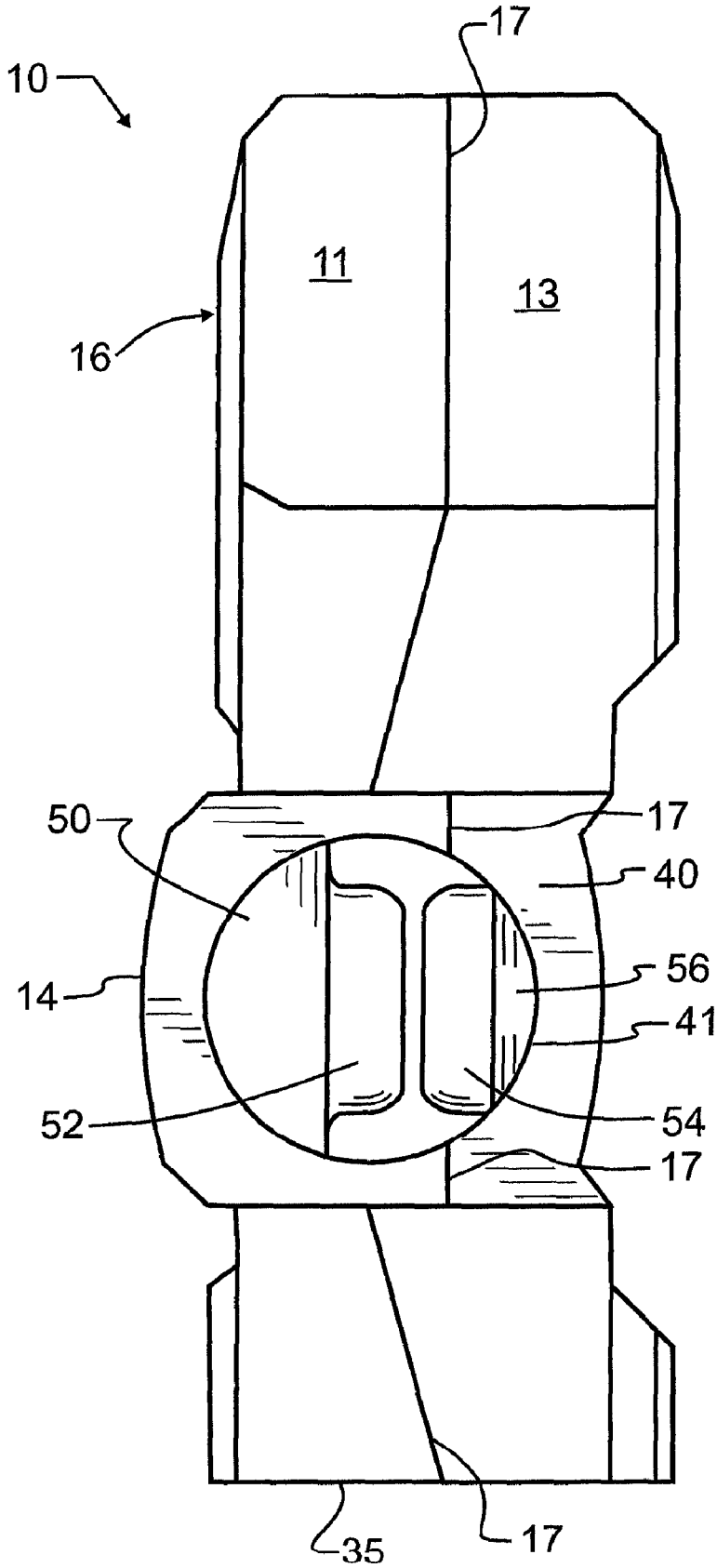
FIG. 2 illustrates the preferred embodiment spindle of FIG. 1 from side plan view.

A preferred embodiment spindle 10 designed in accord with the teachings of the present invention is illustrated in FIGS. 1 and 2 from front plan view and side plan view, respectively. Spindle 10 has a central hole 12 which is designed to slide about an axle, such as axle 19 visible in FIGS. 4 and 5. While the materials and manufacturing method are not critical to proper operation of the present invention, in the preferred embodiment spindle 10 is preferably fabricated from a relatively durable and lubricious plastic such as polyethylene, polypropylene, high density polyethylene (HDPE), ultra-high molecular weight polyethylene (UHMW-PE), polytetrafluoroethylene (PTFE), or other similar polymer. When so fabricated, no additional bearing apparatus need be provided, since hub 14 adjacent to hole 12 will serve as a slippery and durable bushing about an axle. When a relatively low viscosity melt is used, such as is the case particularly with polyethylene, spindle 10 may further be fabricated using rotational molds, thereby substantially reducing the cost of tooling while not reducing the quality of the finished part.

Radiating from hub 14 is a counterweight arm 16, and three target supporting rings 30, 35, and 40. Defining a central axis within hub 14 are bushing surfaces 52, 54, which intrude from surrounding framework 50, 56 respectively, towards each other within the open center of hub 14 adjacent to hole 12. Axle 19 visible in FIGS. 4 and 5 pass through and engage with bushing surfaces 52, 54.

Spindle 10 is, in the preferred embodiment rotationally molded in two halves 11, 13 which engage with each other along a part line 17. Preferably between each of the adjacent target supporting rings 30, 35, 40 and counterweight arm 16 are a plurality of holes 20-26 suitable for receiving a fastener there through. Any suitable fastener or fastening means may be employed, including for exemplary purposes and not limited solely thereto such fasteners as bolts, screws, rivets, swaged plastic pins, adhesives, and other fasteners. The placement of these fasteners as generally illustrated, between adjacent ones of targets 32, 37, 42 and counterweight arm 16 allows spindle 10 to be separated into halves 11, 13, while lending substantial strength and durability to spindle 10. An additional countersunk hole 18 may be provided. This larger countersunk hole may receive a somewhat larger fastener, enabling an interior of counterweight arm 16 to be either hollow or massive. To make counterweight arm 16 massive, it may be filled with a material of greater density than that used to fabricate spindle 10, or simply be entirely solid. As may be apparent, with appropriate design consideration, counterweight arm 16 may be adjustable between uses simply by removing each of the fasteners passing through holes 18 and 20-26, and then placing or inserting a suitable mass into a void or hollow chamber within counterweight arm 16. The removal of these fasteners also permits targets 32, 37, and 42 to be inserted into spindle 10.

Figure 3:
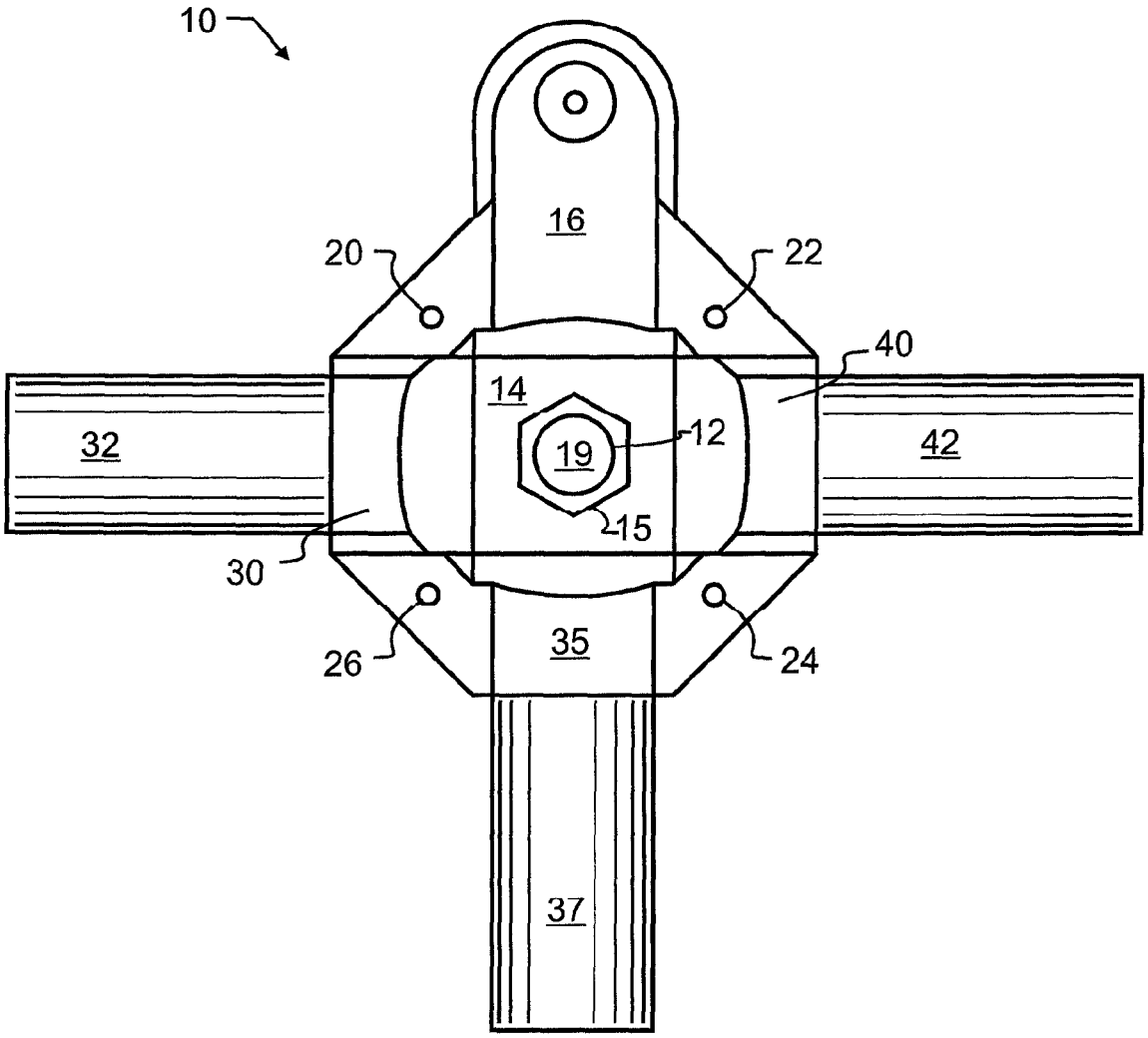
FIG. 3 illustrates a preferred embodiment combination spindle and three targets mounted upon an axle, the combination designed in accord with the teachings of the present invention, from a front plan view.

FIG. 3 illustrates the preferred embodiment spindle 10 in further combination with three targets 32, 37, and 42, all mounted upon an axle 19. To maintain spindle 10 upon axle 19, some type of fastener 15 is provided, which may for exemplary purposes and not limited thereto comprise such apparatus as a cap nut, a Nylok™ nut, a nut and set screw combination, a cotter pin and washer, or any of the other myriad apparatus known to be useful for this purpose. In the preferred embodiment, targets 32, 37, and 42 are spaced at equal ninety degree intervals, as is counterweight arm 16. This arrangement, when counterweight arm 16 does not have mass as great as the mass of targets 32, 37, and 42, will cause spindle 10 to first spin in one direction, and then to oscillate or rock alternately clockwise and counterclockwise before finally coming to a rest after a target has been struck. This oscillation, in combination with the option of any of the three targets 32, 37, and 42, has proved to be of great benefit and advantage when compared with the two and four arm targets of the prior art. A prior art two or four arm target will rotate smoothly and consistently before coming to a stop. This smooth rotation does not require as much timing and concentration on the part of a batter as is desired. An unbalanced two-arm batting practice aid such as illustrated in U.S. Pat. No. 5,833,555 by Jer-Min incorporated herein above will potentially oscillate or rock before stopping. However, only one target is presented, which means that it is far more difficult for a batter to emulate different pitches. To better explain this phenomenon, it will be recognized that in the present invention as the arms start to rock back and forth, no longer completing full rotations, arms 32 and 42 will approach zero velocity at a point on a clock face relative to axle 19 most closely to the 12 o'clock or straight up position. A batter to obtain the best hit should be swinging the bat perpendicular to the target. With the target at 12 o'clock, the batter is swinging the bat relatively parallel to the ground, which is the swing used to strike a fast ball pitch. In contrast, a slider will be emulated when the target is struck approximately at the eleven o'clock position, meaning the swing will need to be rising rather than remaining parallel to the ground. A curve ball will be emulated by hitting a target at or close to the ten o'clock position, meaning the swing will need to rise even more than with a slider. Since the preferred embodiment spindle 10 will stall with either target 32 or 42 very close to and even just beyond the 12 o'clock position, striking one of these targets at or near the reversal will emulate striking a fastball. If, instead, target 37 is struck at this time, it will be angularly offset from the 12 o'clock position and will instead emulate a change-up pitch, curve ball or even extreme curve ball. In accord with a preferred practice method using spindle 10 and targets 32, 37, and 42, one of the targets may be selected randomly, pseudo-randomly or otherwise unpredictably or variably by any suitable means, including but not limited to the batter, a coach, or electrical, electromechanical or electronic apparatus. To more readily facilitate the identification of a particular target, the preferred embodiment targets 32, 37, and 42 are color-coded, so for exemplary purposes target 32 may be white, target 37 may be red, and target 42 may be blue. The selection apparatus may then even be a color-coded light or auditory command which is controlled electronically or otherwise to emanate or illuminate while spindle 10 is still rotating. The selection of a particular target will most preferably occur while spindle 10 is still completing full rotations, prior to beginning the rocking motion of incomplete rotations. The batter will then strike the selected target at or near the apex of travel, and depending upon the target selected, the batter will have to swing differently to emulate different pitches. In addition, the batter will need to concentrate on the movement of the target to initiate or time the swing appropriately, to pull the trigger at just the right instant.

The preferred embodiment spindle 10 and targets 32, 37, and 42 provide feedback to a batter through sight, sound and feel, once more very closely emulating actual batting. The batter will visually detect the speed induced by the bat striking a target, and will know how well the target was struck. Likewise the sound will be crisp and clear with a perpendicular strike, but will be less so with a more glancing blow. Finally, if the batter hits too high or low, the feel will change, as will it when the swing glances off the target rather than connecting squarely therewith.

Figure 4:
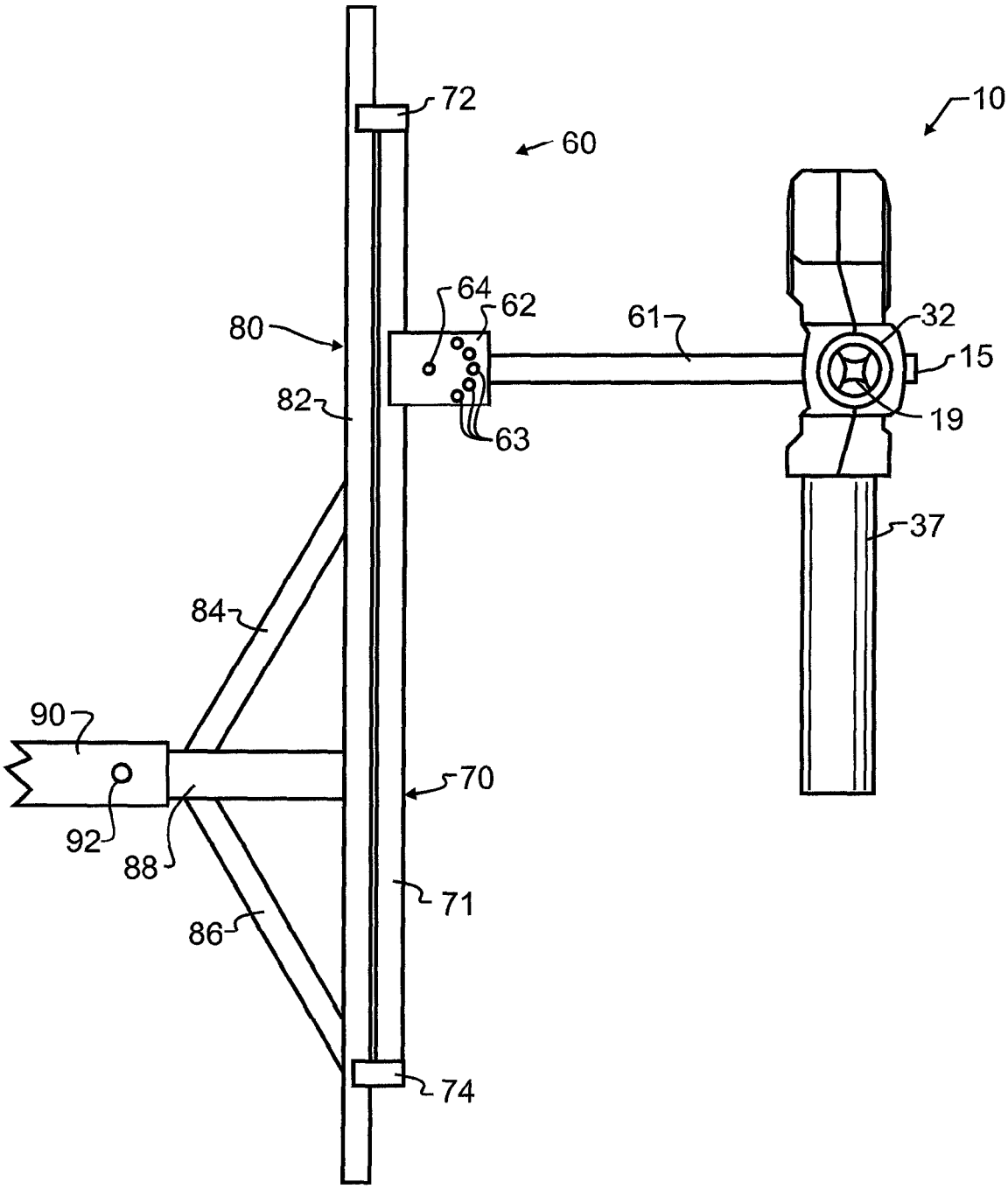
FIG. 4 illustrates the preferred embodiment combination spindle and three targets mounted upon an axle of FIG. 3 in further combination with a receiver hitch support from side plan view.

FIG. 4 illustrates the preferred embodiment combination spindle 10 and three targets 32, 37, and 42 mounted upon axle 19 and in further combination with a receiver hitch support 60. In the preferred embodiment, targets 32, 37, and 42 are comprised by hollow elastomers that are reinforced for strength and durability, such as cloth-reinforced rubber hose or tubing similar to automotive radiator hose. From the side plan view of FIG. 4, when target 32 is parallel to the ground the axle 19 is visible through the center of target 32. Preferably, targets 32 and 42 are formed unitarily as a single common tube, with a small hole formed centrally therein through which axle 19 and bushing surfaces 52, 54 may pass. Target 37 may also be coupled about axle 19, or may alternatively be securely adhered to targets 32, 42, the particular coupling between targets 32, 37, and 42, bushing surfaces 52, 54 and axle 19 which will be determined by one of reasonable skill in the field at the time of design or fabrication.

Receiver hitch support 60 illustrates one preferred method of supporting spindle 10 and targets 32, 37, and 42. A shaft 61 pivots about pivot point 64, which may be a shoulder bolt, pin, rivet or other suitable fastener, and supports axle 19 distal to pivot point 64. A plurality of holes 63 are also provided in bracket 62, so that the angular orientation of shaft 61 relative to bracket 62 may be varied as desired. A pin, bolt or other fastener may pass through one or more of the holes 63 to retain shaft 61 at a selected orientation. This can be particularly useful when a support post is not perpendicular to the ground, though there may also be times when, even if the support post is perpendicular, a particular batter may elect an angle for shaft 61 other than parallel to the ground.

Preferably, bracket 62 is adjustably clamped or otherwise fastened to riser 70. Riser 70 includes a runner 71 and terminating clamps 72, 74. Bracket 62 may be slid or otherwise moved relative to runner 71 to permit a batter or other person to set the height of spindle 10 as desired. When a suitable position is selected, appropriate clamping or fixing means are used to secure bracket 62 in a fixed position relative to runner 71.

Clamps 72, 74 are, in the embodiment of FIG. 4, shown clamped rigidly to vertical member 82 of hitch receiver support framework 80. Braces 84, 86 rigidly couple vertical member 82 to horizontal member 88, which preferably slides into a trailer hitch receiver 90. Trailer hitch receiver 90 is well-known in the prior art to permit coupling between a vehicle and a plurality of apparatus including but not limited to trailers, and to ensure secure engagement therebetween a pin 92 will pass through a hole in both trailer hitch receiver 90 and horizontal member 88. The inclusion of hitch receiver support framework 80 permits the preferred apparatus to be used even when traveling to very diverse locations. Since targets 32, 37, 42 are securely coupled to spindle 10, there is no risk to either a vehicle or any persons nearby during batting practice.

While inclusion of hitch receiver support framework 80 is advantageous in some situations, in other situations different structures may desirably be used to support spindle 10. In such instances, such as when a portable basketball pole, ground or otherwise permanently anchored pole, clothesline, or even fence post or any others of a myriad of similar supports are available, clamps 72, 74 may instead be clamped directly to one of these diverse supports, without requiring hitch receiver support framework 80. In some instances, these diverse supports may not be vertical, and so holes 63 may be used in combination with pivot point 64 to bring shaft 61 parallel to the ground, if so desired.

In one conceived alternative embodiment, and merely to better illustrate the scope of the present invention without limitation thereto, a triangular support may be used to replace bracket 62 and holes 63, whereby shaft 61 would extend from pivot 64 and further be supported by another shaft extending from riser 71 to some point along shaft 61 spaced from pivot 64. If this other shaft is either length adjustable, such as with a screw-thread, telescopic movement, fluid cylinder, or the like, or adjustable at where on shaft 61 it couples therewith, the inclination of shaft 61 may be controlled and adjusted to afford adjustment similar to the illustrated preferred embodiment.

Figure 5:
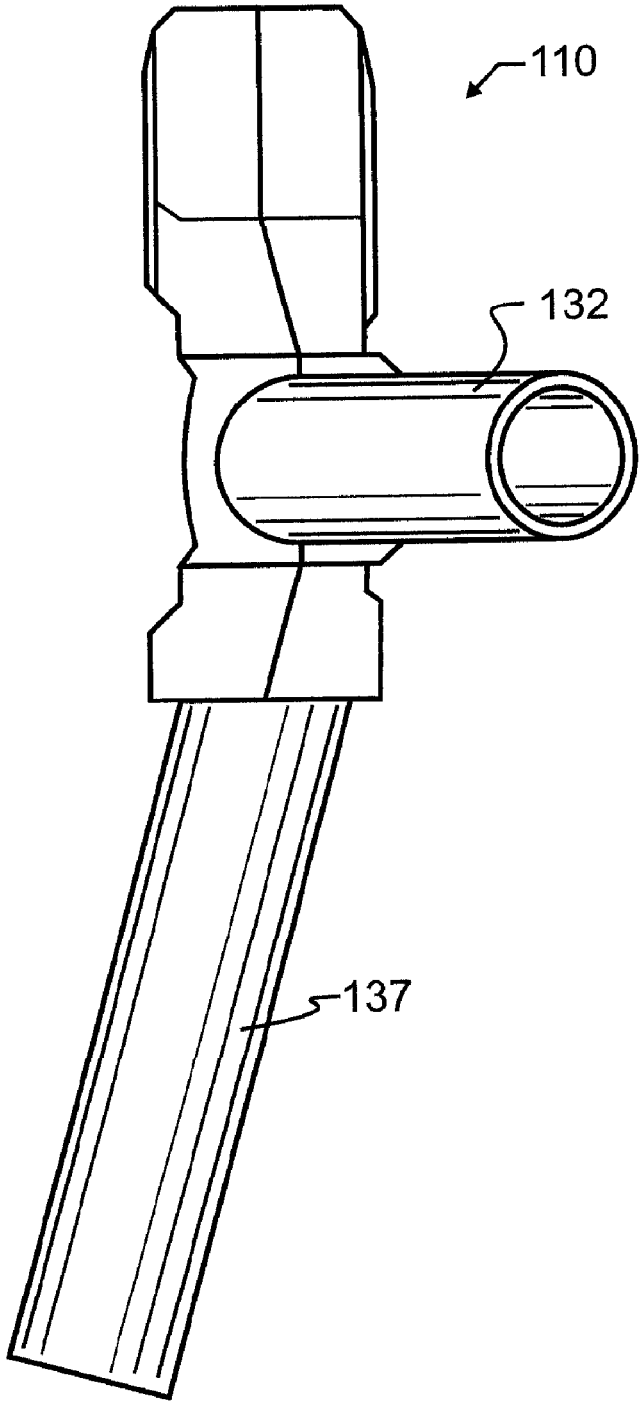
FIG. 5 illustrates a first alternative embodiment spindle designed in accord with the teachings of the present invention from side plan view.

A first alternative embodiment spindle 110 is illustrated in FIG. 5. While otherwise like spindle 10, spindle 110 differs in the angular orientation of targets 132, 137 and 142 not shown. In the preferred embodiment spindle 10, targets 32, 37, 42 each have a longitudinal axis that is co-planar with each other target longitudinal axis, and each of these axes extend radially from axle 19. In contrast, the longitudinal axis of target 137 forms an acute angle with axle 19, while the longitudinal axis of targets 132 and 142 form an obtuse angle with axle 19. This additional angular offset, which causes the target longitudinal axes to no longer be co-planar, means that different targets may be designed to not only emulate fast balls, curves and sliders, but also emulate pitches that are closer to or farther from the batter. In many cases, these differences in distances are preferred by a batter who is trying to direct a hit one direction or another. For exemplary purposes, a target that is slightly closer to or farther from the batter may be used to "push" or "pull" the ball, allowing the batter to hit to all fields. Using this angular offset of spindle 110, a batter may emulate a wider variety of pitches than can be emulated with spindle 10.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary purposes, the preferred and alternative embodiment spindles 10, 110 provide a hollow opening within which tubular targets are inserted and retained. Other suitable couplings may also be used, including but not limited to protrusions from the spindle which slip interiorly of the tubular targets, and about which a clamp may be fastened. Where the tubular targets and spindle may be fabricated to have threading, the targets may be screwed into mating threads formed into the spindle. Likewise, while three targets arranged to rest at the 3 o'clock, 6 o'clock and 9 o'clock positions is believed to be vastly superior to two and four arm practice apparatus, the angular offset of targets 132, 137 creates opportunity for more options in both number and arrangement of targets. Again for exemplary purposes only, an eight target spindle is contemplated having four arms with longitudinal axes all coplanar and perpendicular to the axle and each offset from adjacent ones by ninety degrees, and four additional targets, two with longitudinal axes forming angles obtuse to the axle similar to targets 132, 142, and two more with angles acute to the axle, similar to target 137. The targets not perpendicular to the axle may be offset from each other also by ninety degrees from each other, and interspersed between the axle-perpendicular targets Even the angle of offset between adjacent targets may be varied. Consequently, the scope of the invention is set forth and particularly described in the claims herein below.

I claim:

1. A batting practice apparatus, comprising:

a spindle having a central hole, a hub immediately adjacent said central hole, and three target supporting rings;

an axle passing through said spindle central hole;

three targets, each one of said three targets coupled with a respective one of said three target support rings, said axle passing through at least one of said three targets; and a counterweight arm radiating from said spindle hub;

wherein said three targets are spaced at ninety degree intervals from an adjacent target, thereby causing spindle to first spin in one direction, and then to oscillate or rock alternately clockwise and counterclockwise before finally coming to a rest after a target has been struck; and wherein at least two of said three targets further comprise a unitary common tube defining at distal longitudinal ends said two of said three targets, said unitary common tube having a small hole formed centrally therein through which said axle and said hub pass.

2. The batting practice apparatus of claim 1, wherein said counterweight arm has a mass different from a mass of individual ones of said three targets.

3. The batting practice apparatus of claim 1, wherein said three targets further comprise hollow tubular elastomers.

4. The batting practice apparatus of claim 3, wherein said three targets further comprise fiber reinforced rubber hose.

5. The batting practice apparatus of claim 1, wherein said three targets each have a longitudinal axis that is co-planar with each other of said three targets' longitudinal axis, and each of these axes extend radially from said axle.

6. The batting practice apparatus of claim 2, further comprising a plurality of holes suitable for receiving a fastener there through between each of adjacent ones of said three target supporting rings and said counterweight arm.

7. The batting practice apparatus of claim 2, wherein an interior of said counterweight arm comprises a mass different from said three targets.

8. The batting practice apparatus of claim 7, wherein said interior of said counterweight arm is partially hollow.

9. The batting practice apparatus of claim 1, further comprising a means for indicating a selected one of said targets for striking while spindle is still rotating.

10. The batting practice apparatus of claim 1, wherein said hub further comprises a durable and lubricious plastic, wherein said hub will operate as a slippery and durable bushing for rotation of said spindle about said axle.

11. The batting practice apparatus of claim 10, wherein said spindle is rotationally molded using a low viscosity polymer melt in two halves which engage with each other along a part line.

12. A readily adaptable batting practice support, comprising:

a spindle having a central hole, a hub immediately adjacent said central hole, and a plurality of target supporting rings;

an axle passing through said spindle central hole;

a plurality of targets each one of said plurality of targets coupled with a respective one of said plurality of target support rings, said axle passing through at least one of said plurality of targets;

a bracket having a pivot therein and coupled to said spindle;

a shaft pivotal about said bracket pivot;

a riser having a runner and terminating clamps; and a counterweight arm radiating from said spindle hub;

said bracket adjustably coupled to said riser and repositionable relative to said runner to permit a person to adjust a height of said spindle; and wherein said plurality of targets are spaced at ninety degree intervals from an adjacent target, thereby causing spindle to first spin in one direction, and then to oscillate or rock alternately clockwise and counterclockwise before finally coming to a rest after a target has been struck; and wherein at least two of said plurality of targets further comprise a unitary common tube defining at distal longitudinal ends said two of said plurality of targets, said unitary common tube having a small hole formed centrally therein through which said axle and said hub pass.

13. The readily adaptable batting practice support of claim 12, wherein said bracket further comprises a plurality of holes so that the angular orientation of said shaft relative to said bracket may be varied as desired.

14. The readily adaptable batting practice support of claim 12, further comprising: clamps clamped rigidly to a vertical member of a hitch receiver support framework; and a horizontal member coupled with said hitch receiver support framework, operative to engage with a trailer hitch receiver.

15. The readily adaptable batting practice support of claim 12, further comprising clamps operatively clamped directly to an otherwise independent support.

16. The readily adaptable batting practice support of claim 12, wherein said bracket further comprises a triangular support, said shaft extending from said bracket pivot and further supported by a second shaft extending from said riser to some point along said shaft spaced from said bracket pivot.

17. A multi-variable batting practice spindle, comprising:

a spindle having a hole, a hub immediately adjacent said hole, and a plurality of target supports;

an axle passing through said spindle hole;

a plurality of targets, each one of said targets coupled with a respective one of said plurality of target supports and each one of said targets defining a longitudinal axis; said axle passing through at least one of said plurality of targets; and a counterweight arm radiating from said spindle hub which has a mass different from a mass of individual ones of said three target;

a longitudinal axis of a first one of said plurality of targets forming an acute angle with said axle;

a longitudinal axis of a second one of said plurality of targets forming an obtuse angle with said axle; wherein said target longitudinal axes are not co-planar; and wherein said plurality of targets are spaced about said spindle at ninety degree intervals from an adjacent target, thereby causing spindle to first spin in one direction, and then to oscillate or rock alternately clockwise and counterclockwise before finally coming to a rest after a target has been struck; and wherein at least two of said plurality of targets further comprise a unitary common tube defining at distal longitudinal ends said two of said plurality of targets, said unitary common tube having a small hole formed centrally therein through which said axle and said hub pass.

* * * * *